US011266219B2

(12) United States Patent
Caulier et al.

(10) Patent No.: US 11,266,219 B2
(45) Date of Patent: Mar. 8, 2022

(54) SET COMPRISING A MAKEUP PRODUCT AND AN APPLICATOR

(71) Applicant: L'OREAL, Paris (FR)

(72) Inventors: Eric Caulier, Clichy (FR); Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 347 days.

(21) Appl. No.: 15/542,027

(22) PCT Filed: Jan. 5, 2016

(86) PCT No.: PCT/EP2016/050091
§ 371 (c)(1),
(2) Date: Jul. 6, 2017

(87) PCT Pub. No.: WO2016/110492
PCT Pub. Date: Jul. 14, 2016

(65) Prior Publication Data

US 2018/0000222 A1 Jan. 4, 2018

(30) Foreign Application Priority Data

Jan. 6, 2015 (FR) ..... 15 50067

(51) Int. Cl.
*A45D 40/24* (2006.01)
*A45D 33/36* (2006.01)
(Continued)

(52) U.S. Cl.
CPC ..... *A45D 33/36* (2013.01); *A45D 33/005* (2013.01); *A45D 34/04* (2013.01); *A45D 40/26* (2013.01); *A45D 2200/1018* (2013.01)

(58) Field of Classification Search
CPC ..... A45D 33/00; A45D 33/006; A45D 33/34; A45D 33/36; A45D 33/005; A45D 40/26;
(Continued)

(56) References Cited

U.S. PATENT DOCUMENTS 2,556,584 A * 6/1951 Frank ..... B65D 35/56 132/308
3,568,236 A * 3/1971 Aston ..... A45D 40/28 15/244.1
(Continued)

FOREIGN PATENT DOCUMENTS

CH 155730 A * 7/1932
DE 10 2006 040241 A1 3/2008
(Continued)

OTHER PUBLICATIONS

Apr. 4, 2016 International Search Report issued in International Patent Application No. PCT/EP2016/050091.
(Continued)

*Primary Examiner* — Rachel R Steitz
(74) *Attorney, Agent, or Firm* — Oliff PLC

(57) ABSTRACT

The present invention relates to a set comprising a makeup product and a cosmetic applicator for applying this product, the applicator comprising a stem and an application member borne by the stem, the latter comprising a flexible portion (14) of wavy shape, of flattened cross section on a major axis, the flexible portion comprising a succession of elementary patterns, the flexible portion (14) having its angular deflection about the major axis limited by elementary patterns coming into mutual abutment.

17 Claims, 1 Drawing Sheet

Figure 1:
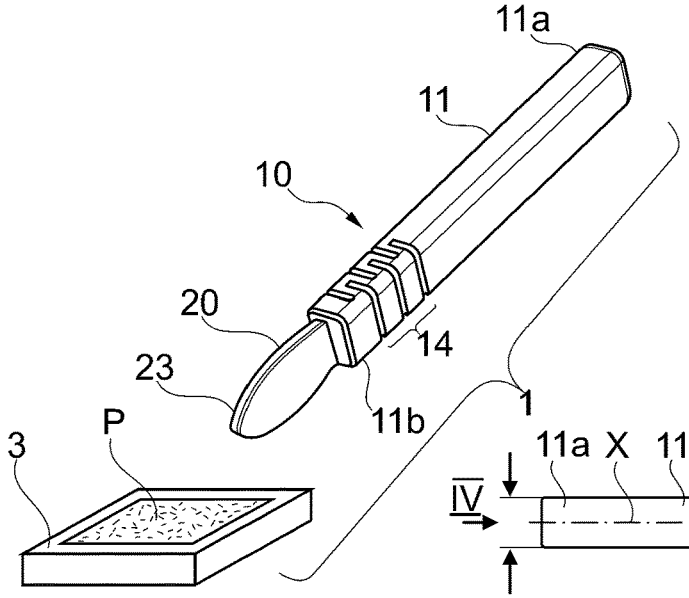

(51) Int. Cl.
*A45D 40/26* (2006.01)
*A45D 34/04* (2006.01)
*A45D 33/00* (2006.01)

(58) Field of Classification Search
CPC ..... A45D 40/262; A45D 2200/1018; A46B 5/002; A46B 5/0062; A46B 5/0066; A46B 2200/1046; A46B 9/021
USPC ..... 401/130, 266
See application file for complete search history.

(56) References Cited

U.S. PATENT DOCUMENTS 4,509,540 A 4/1985 Inagaki
5,458,861 A * 10/1995 Buchanan ..... B01D 53/04 423/244.01
6,033,143 A * 3/2000 Gueret ..... A45D 34/045 401/126
6,205,611 B1 * 3/2001 Vigil ..... A46B 7/04 132/308
6,312,180 B1 * 11/2001 Panda ..... A45D 40/265 401/126
8,454,097 B2 * 6/2013 Gueret ..... A45D 34/045 300/21
2005/0031400 A1 2/2005 Marcotte et al.
2007/0000513 A1 1/2007 Gueret
2010/0007193 A1 1/2010 Gueret
2012/0227200 A1 9/2012 Kraemer

FOREIGN PATENT DOCUMENTS

EP 1738894 A1 1/2007
EP 2027792 A1 2/2009
FR 2868265 A1 10/2005
FR 2996739 A1 4/2014
WO 2005/077236 A1 8/2005
WO 2007/132715 A1 11/2007
WO WO 2008/025443 * 3/2008

OTHER PUBLICATIONS

Jul. 11, 2017 International Preliminary Report on Patentability issued in International Patent Application No. PCT/EP2016/050091.

* cited by examiner

SET COMPRISING A MAKEUP PRODUCT AND AN APPLICATOR

The present invention relates to cosmetic applicators and more particularly to those that comprise a support stem and an application member borne by the stem, the latter comprising a flexible portion.

Applicators of this type are described in applications US 2005/0031400 A1 and FR 2 996 739.

In application US 2005/0031400 A1, the flexible portion is defined by a narrowing of the cross section of the stem, possibly combined with the use of an elastically deformable material from which to make this flexible portion.

The applicator described in application FR 2 996 739 seeks to allow better control over the flexibility of the applicator by giving the flexible portion a flattened cross section and a particular length.

Application FR 2 868 265 discloses an applicator comprising a flexible portion which may be defined by a helical spring or by axial or helical threads of material. That document also divulges a flexible portion in the form of a diabolo or a succession of hollowed annular parts or parts in the form of a bellows spring.

U.S. Pat. No. 4,509,540 describes an applicator with a flexible portion constituted by a spring.

Application EP 2 027 792 discloses a vibrating applicator comprising an application member carried out by a stem provided at its end with a flexible portion configured to increase the amplitude of vibration of the application member. The flexible portion is in one embodiment a helical or wavy portion.

There is a need to improve this type of applicator further in order notably to allow the user better control over the loading of the application member with product and the application of the makeup.

The invention achieves this using a set comprising a makeup product and an applicator for applying this product, comprising a flexible portion of wavy shape, of flattened cross section on a major axis of the section, the flexible portion defining a succession of elementary patterns, the flexible portion having its angular deflection about the major axis of the section limited by at least two consecutive elementary patterns coming into mutual abutment.

In the invention, the fact that the flexible portion has a limited angular deflection allows the user better control over the loading of the application member with product, because once the flexible portion is in abutment, the user can more easily control the force applied by the application member to the product or to the surface that is to be made up, by pressing the applicator more or less firmly.

When using it to apply the product, the user can thus control more precisely the application and the pressure applied by the application member to the surface that is to be made up.

Likewise, the user can more easily control the loading of the applicator with product.

Finally, the flattened cross section increases the rigidity in one direction, something that allows the user to move the application member in this direction with less deformation of the flexible portion, so as to apply makeup accurately.

The applicator preferably comprises a stem and the application member is borne by the stem, the latter comprising the flexible portion.

The elementary patterns are in the form of crenulations.

The maximum angular deflection is less than 90° with respect to a rest configuration.

The flexible portion connects to a handle of rectangular cross section with its major sides parallel to the major axis.

The shape factor M/n of the cross section of the flexible portion is comprised between 1 and 30.

The flexible portion defines a succession of grooves alternately opening onto opposite sides of the applicator. For preference, there are as many grooves on one side as on the other, but as an alternative, the number of grooves differs. Thus, the term "wavy" is to be understood in the broadest sense, as having at least one wave, and the flexible portion of wavy shape may comprise a portion, the corresponding grooves of which open onto just one side.

The number of grooves opening onto one side may be comprised between 1 and 10, the total number of grooves preferably being less than 10.

The flexible portion is moulded with a handle.

The flexible portion and the handle are in the same material.

The flexible portion is moulded with an extension which constitutes a core for the application member.

The extension is covered on all sides about its axis with a covering, notably made of foam.

The covering extends axially beyond the extension.

The extension is of flattened shape in a direction parallel to the said major axis.

The total length of the applicator, excluding the application member, is comprised between 3 and 40 mm, better between 3 and 15 mm, better still between 10 and 15 mm.

The application member exhibits symmetry with respect to a plane of symmetry, notably perpendicular to the major axis, and better still exhibiting axial symmetry.

Figure 2:
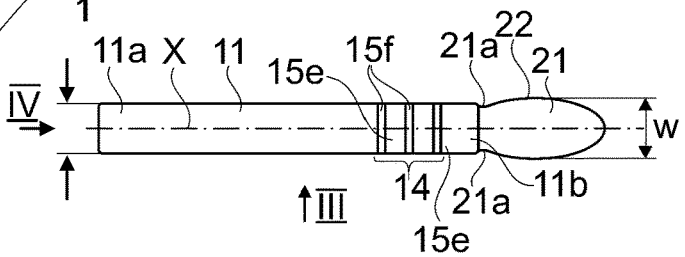
Figure 3:
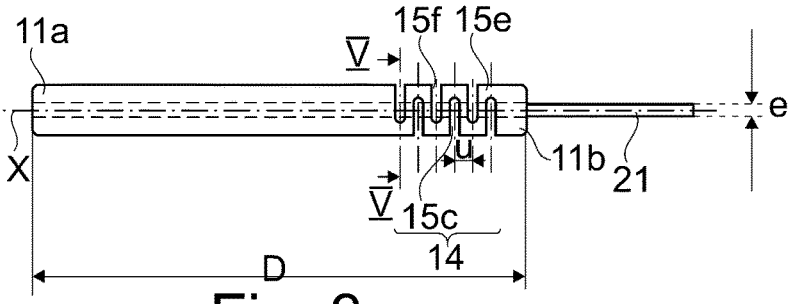
Figure 4:
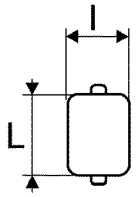
Figure 5:
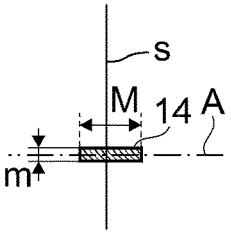
Figure 6:
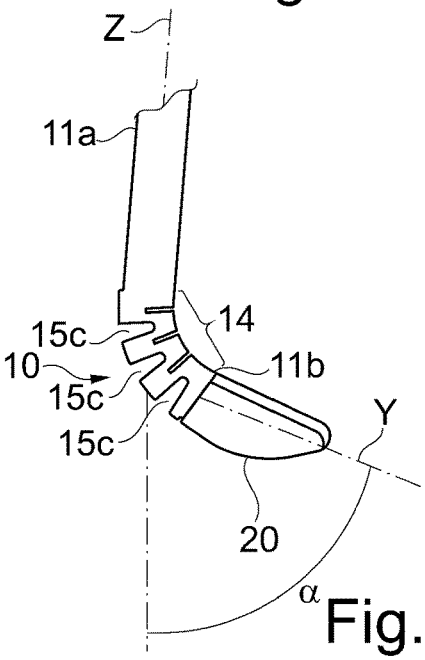
Figure 7:
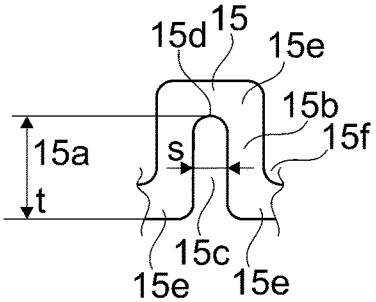
Figure 8:
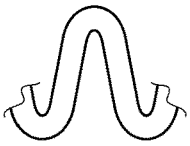
Figure 9:
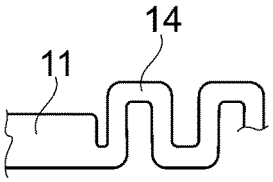

The invention may be better understood from reading the following detailed description of non-limiting illustrative embodiments thereof and from examining the appended drawing, in which:

FIG. 1 is a schematic perspective depiction of a packaging and application set according to the invention, FIG. 2 depicts the applicator of FIG. 1 separately, without the covering of the application member, FIG. 3 is a side view on arrow III of FIG. 2, FIG. 4 is a rear view on IV of FIG. 2, FIG. 5 is a section on V-V of FIG. 3, FIG. 6 illustrates the applicator of FIG. 1 with the flexible portion in abutment, FIG. 7 depicts an embodiment detail of the flexible portion, in longitudinal section, FIG. 8 is a view similar to FIG. 7 of an alternative form of embodiment, FIG. 9 illustrates an alternative form of embodiment of the flexible portion.

The packaging and application set 1 depicted in FIG. 1 comprises a product P, for example in the form of loose or compacted powder, present in a cup 3, and an applicator 10 comprising a handle 11 and an application member 20 designed to pick up the product P and apply it to the human keratinous substances that are to be made up, for example to the skin of the eyelids. The product may even be a mascara or a lip gloss.

Where appropriate, the product P and the applicator 10 may be contained in a case, not depicted, having a base and a lid that closes the base. The base may potentially house several cups each containing a product to be applied. The lid may be articulated to the base.

As may be seen notably in FIG. 2, the handle 11 is of elongate shape along a longitudinal axis X, preferably rectilinear as illustrated.

The handle 11 may have a cross section of generally rectangular shape, as can be seen in FIG. 4, for example with a flatness factor L/l of between 1 and 4, L denoting the length and l the width thereof.

The handle 11, of length D, is extended at its distal end by an extension 21 which constitutes the core of the application member 20.

In the example considered, this extension 21 is moulded as a single piece in the same material as the handle 11, and has a flattened shape along a plane of flattening which is parallel to the major sides of the cross section of the handle 11. The extension 21 has, for example, as illustrated in FIG. 2 in a face-on view, a contour 22 of substantially oblong shape ending at the end comprising the handle 11 with two opposite edges 21*a* which are parallel to the axis X.

The application member 20 may comprise a covering 23, for example made of foam, overmoulded or fixed some other way on the extension 21. This covering 23 may extend beyond the extension 21 along the axis X, at the same end as the distal end of the applicator. The covering 23 may also overhang the extension 21 laterally. In the example of FIG. 1, the covering 23 thus extends all around the extension 21 and forward thereof.

In an alternative form of embodiment which has not been illustrated, the covering 23 is not made of foam but is constituted by floccing.

The thickness e of the extension 21 is comprised for example between 0.6 and 2 mm and its greatest width ω is, for example, slightly greater than the length L of the major sides of the cross section of the handle.

The length D of the handle 11 is for example comprised between 45 and 55 mm. For example the length L is comprised between 4 and 6 mm and the width l is comprised between 3 and 4.5 mm.

The handle 11 comprises a flexible portion 14, more particularly visible in FIG. 3. This flexible portion 14 is of wavy shape with a succession of elementary patterns 15, one of which has been depicted separately in FIG. 7.

The flexible portion 14 may as illustrated define waves in the form of crenulations. The flexible portion 14 defines what is referred to as a "concertina" zone.

The flexible portion 14 is closer to the distal end of the handle 11 than to the proximal end thereof.

Each elementary pattern 15 in the example considered is in the form of crenulations, with two flexible branches 15*a*, 15*b* substantially mutually parallel and perpendicular to the longitudinal axis X, these two branches between them defining a groove 15*c* that has a rounded bottom 15*d*. The two branches 15*a*, 15*b* are joined together by a connecting part 15*e* which extends substantially parallel to the axis X. Each branch 15*a* and 15*b* is bent over at its opposite end to the intermediate portion 15*e*, so as to connect to the handle or to an adjacent elementary pattern.

The branch 15*b* of an elementary pattern thus connects with the branch 15*a* of the next pattern via an intermediate portion 15*e* and therewith defines a groove 15*f* opening onto the opposite side from the side onto which the groove 15*c* opens. The grooves may also be referred to as slots when they are relatively narrow.

The flexible portion 14 forms a succession of crenulations opening alternately onto one side of the applicator and the other, as can be seen notably in FIG. 3.

The branches 15*a* and 15*b* and the intermediate connecting parts 15*e* have a cross section of flattened shape, as illustrated in FIG. 5, with the major axis A parallel to the plane of FIG. 2 and perpendicular to that of FIG. 3 and a plane of symmetry S perpendicular to the major axis A.

The form factor M/n given by the ratio of the width M of the flexible portion with respect to the thickness n thereof, in cross section, is preferably comprised between 1 and 30.

The width s of a groove 15*c* or 15*f*, mid-way along the length thereof, is preferably comprised between 0.6 and 3 mm.

The length t of a groove 15*c* or 15*f* is, for example, comprised between 1 and 6 mm.

The width of the grooves allows the angle of deformation to be calculated and altered; the width may be variable, where appropriate, so as to cause the degree of deformation to vary along the flexible portion. Thus, the shape of the elementary patterns may vary.

When the applicator 10 is being used, the flexible portion 14 may deform as illustrated in FIG. 6, the grooves 15*c* opening onto one and the same side of the applicator having their opposite sides diverge outwards whereas the grooves opening onto the opposite side of the applicator, in this instance the grooves 15*f* in the example illustrated, have their opposite sides converging towards the outside. The grooves 15*f* substantially close up when the flexible part 14 comes into abutment, which means to say when two consecutive branches 15*a* and 15*b* come to rest one against the other on the opposite side to the bottom 15*d* of the groove 15*f* defined between them, thereby making it more difficult to achieve additional flexural deformation of the flexible part 14. When the deformation is substantially at its maximum, as illustrated in FIG. 6, the axis Y of the distal portion 11*b* of the handle 11 makes for example an angle α with the longitudinal axis Z of the proximal portion 11*a* of the handle, which angle is less than 90° and, for example, comprised between 20 and 85°.

The length at rest of the flexible portion 14, along the axis X, is for example comprised between 3 and 20 mm. The distance u separating two consecutive grooves opening onto opposite sides of the flexible part 11, namely a groove 15*c* and a groove 15*f* or a groove 15*f* and a groove 15*c*, measured between the median planes of the said grooves which are perpendicular to the axis X, is preferably comprised between 1.2 and 1.6 mm and, for example, takes the value 1.4 mm.

The radius of curvature at the bottom of the groove 15*e* or 15*f* is preferably comprised between 0.2 and 0.5 mm, for example being 0.35 mm.

In order to use the applicator, the user moves the application member 20 to the surface of the product P in order to load the applicator with product. Next, the user can apply makeup to the skin by moving the applicator with the application member 20 in contact with the skin.

For preference, the application member 20 is moved with the direction of flattening of the extension 21 substantially parallel to the skin, making the application somewhat gentle. As an alternative, the user can move the application member 20 over the skin with the major faces of the extension 21 substantially perpendicular to the skin. When the applicator is used in this orientation, the flexible portion 14 deforms far less in bending about a geometric axis parallel to the minor sides of the rectangular cross section of the handle and makeup can be applied accurately. This may be of use for applying makeup around the edges of the eyes or the nose for example. The deformability of the applicator is thus greater about a geometric axis parallel to the major sides of the rectangular cross section of the handle than it is perpendicular thereto.

The invention is not restricted to the example that has just been described.

In particular, it is possible for the flexible portion not to connect directly to a handle which defines the zone via which the applicator is held but to be connected indirectly via a stem to a member for holding, constituted for example by a closure cap intended to be screwed onto the threaded neck of a container in order to close same, it being possible for such a container to be provided with a member for wringing the stem of the applicator.

In alternative forms of embodiment that have not been illustrated, the handle 11 at its distal end has a housing that accepts an end fitting for fitting an application member, for example a felt tip or an application member that has a core made from a material different from that of the handle 11, for example metallic or elastomeric.

The shape of the flexible portion 14 and notably that of the elementary patterns that constitute the waves can be modified.

Thus, as illustrated in FIG. 8, the elementary patterns may be in the form of arches rather than crenulations.

For preference, the wavy undulations are centred on a median plane for the applicator member 20, as is the case with the applicator in FIG. 1. As an alternative, the wavy undulations are offset to one side of the applicator as illustrated in FIG. 9, in order to encourage the centring of the grasp with respect to one side of the applicator.

For preference, the flexible portion comprises identical elementary patterns which repeat, giving periodic waves. As an alternative, the elementary patterns are not identical, giving pseudoperiodic or aperiodic waves so that the force needed to achieve bending evolves.

For preference, the flexible portion 14 is made in a non-elastomeric material which is the same as that from which the handle 11 is moulded, for example a thermoplastic. As an alternative, the flexible portion 14 is made of a material different from that of the handle 11, notably a less rigid material.

It is possible to have a different number of grooves on one side of the applicator compared with the other, so as to have two different flexibilities.

The applicator according to the invention can be used to apply a product to the eyelashes or the eyebrows, notably mascara, or to the lips, notably a lip gloss.

The expression "comprising a" is synonymous with "comprising at least one".

The invention claimed is:

1. Set comprising a makeup product and a cosmetic applicator for applying this product, the applicator comprising a stem and an application member borne by the stem, the application member comprising a flexible portion of wavy shape, of flattened cross section on a major axis of the cross section, the flexible portion comprising a succession of elementary patterns, the flexible portion having its angular deflection about the major axis limited by elementary patterns coming into mutual abutment, the flexible portion defining a succession of grooves alternately opening onto opposite sides of the applicator in such a way that at any axial position along a longitudinal axis of the flexible portion where there is one groove opening out on one side of the flexible portion, there is no groove on the opposite side of the flexible portion at said axial position.

2. Set according to claim 1, the elementary patterns being in the form of crenulations.

3. Set according to claim 1, the maximum angular deflection being less than 90° with respect to a rest configuration.

4. Set according to claim 1, the flexible portion being connected to a handle of rectangular cross section with its major sides parallel to the major axis.

5. Set according to claim 1, a shape factor M/n of the cross section of the flexible portion being comprised between 1 and 30, where M is a width of the flexible portion and n is a thickness thereof.

6. Applicator according to claim 1, the number of grooves opening onto one side being comprised between 1 and 10.

7. Applicator as defined in claim 1, the flexible portion being moulded with a handle.

8. Applicator according to claim 7, the flexible portion and the handle being in the same material.

9. Applicator according to claim 7, the flexible portion being moulded with an extension which constitutes a core for the application member.

10. Applicator according to claim 9, the extension being covered on all sides about its axis with a covering.

11. Applicator according to claim 10, the covering extending axially beyond the extension.

12. Applicator according to claim 10, the covering being made of foam.

13. Applicator according to claim 9, the extension being of flattened shape in a direction parallel to the said major axis.

14. Applicator as defined in claim 1, the total length of the applicator, excluding the application member, being comprised between 3 and 15 mm.

15. Applicator as defined in claim 1, the application member exhibiting symmetry with respect to a plane of symmetry.

16. Applicator according to claim 15, the plane of symmetry being perpendicular to the major axis.

17. Applicator according to claim 15, the application member exhibiting axial symmetry.

* * * * *